United States Patent [19]

Heinz, Jr.

[11] 4,245,774

[45] Jan. 20, 1981

[54] CONTAINER SECURITY CLIP

[76] Inventor: Walter F. Heinz, Jr., New Haven, Mich.

[21] Appl. No.: 79,789

[22] Filed: Sep. 28, 1979

[51] Int. Cl.[3] ..... B65D 45/06; B65D 45/16

[52] U.S. Cl. ..... 229/47; 24/259 FS; 52/716

[58] Field of Search ..... 24/81 FT, 259 FS; 52/716; 229/47

[56] References Cited

U.S. PATENT DOCUMENTS

| | | | |
|---|---|---|---|
| 967,605 | 8/1910 | Brooks | 229/47 |
| 1,497,879 | 6/1924 | Richardson | 229/47 X |
| 1,565,898 | 12/1925 | Boutelle | 229/47 |
| 2,354,498 | 7/1944 | Brown | 229/47 X |
| 2,537,801 | 1/1951 | Swatsick | 229/47 |
| 2,741,419 | 4/1956 | Janz | 229/47 |
| 3,145,434 | 8/1964 | Major | 24/259 FS X |
| 3,294,353 | 12/1966 | Rowe | 52/716 X |
| 3,466,710 | 9/1969 | Kupersmit | 229/47 |

FOREIGN PATENT DOCUMENTS

| | | | |
|---|---|---|---|
| 362590 | 5/1963 | Belgium | 24/81 FT |
| 1205341 | 11/1965 | Fed. Rep. of Germany | 24/81 FT |

*Primary Examiner*—Davis T. Moorhead

*Attorney, Agent, or Firm*—Basile, Weintraub & Hanlon

[57] ABSTRACT

A container security clip comprises a U-shaped member adapted to be disposed over the edge of the side wall of an open-ended container. The U-shaped member includes first and second spaced leg portions. The leg portions each include first sharpened projections having a first and integrally formed with the leg and a second end extending vertically upward from the first end between the spaced legs. One of the leg portions includes a second projection integrally formed with the leg on one end and having a second end depending downward and outward from the first end. The first projections are adapted to engage the side wall of the container and embed therein to resist upward movement of the clip relative to the container; while the second projection is adapted to engage and embed in the container closure to resist movement of the closure and to rip the side of the closure if sufficient force is exerted to move it.

10 Claims, 5 Drawing Figures

CONTAINER SECURITY CLIP

BACKGROUND OF THE INVENTION

1. Field of the Invention

This invention relates, in general, to containers and, particularly, to fasteners for retaining a closure on the containers and, more particularly, to security devices for containers which indicate tampering or unauthorized opening of the container.

2. Description of the Prior Art

Many different types of containers, i.e., packages or boxes, are filled with heavy and bulky products or commodities which must be maintained within the container despite rough handling during shipping and storage. In order to prevent spillage or loss of products from within the container, strapping bands or other types of fasteners are applied to the container to hold the container closure or top cover in place on the container.

Such closure fasteners have been made in a variety of different forms. A common type of fastener, as shown in U.S. Pat. Nos. 2,354,498; 2,537,801 and 1,565,898, comprises a bendable strip of metal having a plurality of sharpened projections extending therefrom which are forced or otherwise embedded in the side walls of the container. The end of the fastener is then bent around the side of the top cover and embedded therein to secure the top cover to the container.

It is also known to apply various types of sealing or anti-theft devices, such as the conventional sealing wire with a lead seal affixed thereto, to indicate theft or unauthorized entry into the container. However, such sealing devices require specially designed modifications to the basic container construction thereby increasing the cost of the container. In addition, such sealing devices require time-consuming and costly labor to install and are undependable in function. Further, such sealing devices typically extend outside the sides of the container and, therefore, are susceptible to damage during handling, shipping and storing.

Thus, it would be desirable to provide a security clip for a container which indicates any unauthorized entry or tampering with the container after the goods have been loaded therein. It would also be desirable to provide a security clip for a container which is inexpensive to manufacture and which is easily and quickly applied to the container. It would also be desirable to provide a security clip for a container which is easily applied to the container in a single motion without additional labor in bending or forming the clip in position around the container and closure. Finally, it would be desirable to provide a security clip for a container which also functions to maintain the closure in place on the container.

SUMMARY OF THE INVENTION

There is disclosed herein a container security clip comprising a U-shaped member which is adapted to be disposed over the edge of the side wall of an open-ended container. The U-shaped member includes first and second spaced legs. The legs each include first sharpened projections having a first end integrally formed with the leg and a second end extending vertically upward from the first end between the spaced legs. The upward extending sharpened projections slide easily over the side wall of the container when the security clip is disposed thereover and function to embed themselves in the side walls of the container when the security clip is urged in an upward direction, such as during unauthorized entry or tampering with the container, to thereby resist removal of the clip therefrom.

The outermost leg of the U-shaped member further includes a second sharpened projection integrally formed with the leg on one end and having a second end depending downward and outward from the first end. The second projection, after the container closure is telescoped over the security clip, serves to embed itself in the side of the closure when the closure is urged away from the container. This resists movement of the closure and gives an indication, by ripping the closure, whenever an attempt is made to move it.

In this manner, a visible indication of an unauthorized entry or tampering with the container is effected. Further, by resisting movement of the closure, the container security clip additionally functions to retain the closure on the open-ended container thereby eliminating, in certain instances, the need for additional straps or bands to retain the closure on the container during shipping and handling.

The container security clip of this invention not only is inexpensive to manufacture but, also, it may be quickly and easily installed in a single motion over the edge of the side wall of the container. This compares favorably with similar prior art closure fasteners which must be manually embedded in the side walls of the container and which require additional steps in forming or bending the ends of the fasteners around the corresponding edge of the top cover to retain the same in place on the container. Further, by providing a visible indication of attempted entry into the container, such as by removal of the closure therefrom, the need for additional sealing devices and the time-consuming and costly labor required to install the same is eliminated.

BRIEF DESCRIPTION OF THE DRAWING

The various features, advantages and other uses of this invention will become more apparent by referring to the following detailed description and drawing in which.

DESCRIPTION OF THE PREFERRED EMBODIMENTS

Figure 1:
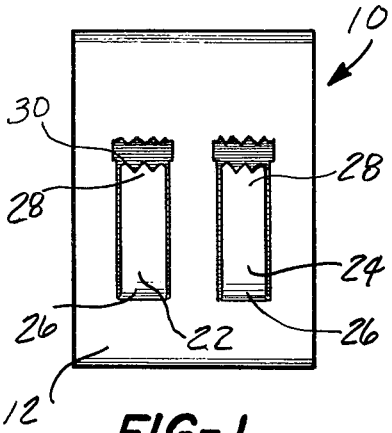
FIG. 1 is a front view of a container security clip constructed according to the teachings of this invention.

Throughout the following description, identical reference numbers are used to refer to the same component shown in multiple figures of the drawing.

Figure 2:
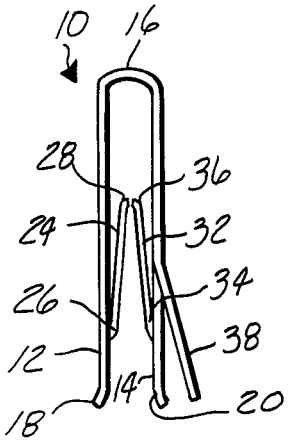
FIG. 2 is a side view of the container security clip shown in FIG. 1.
Figure 3:
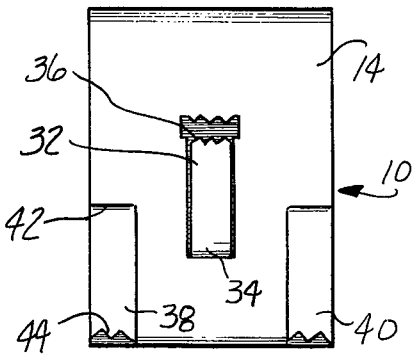
FIG. 3 is a rear view of the container security clip shown in FIGS. 1 and 2.

Referring now to the drawing, and to FIGS. 1, 2 and 3, there is shown a security clip 10 suitable for use with open-ended containers. The container security clip 10 of this invention is especially suited for use with containers formed of paper or paper fiber products, such as the more commonly known corrugated containers. Such containers generally comprise an open-ended rectangular or square box formed of four side walls, a top portion or cap and a bottom portion or base. The containers are formed in a wide variety of configurations in which the cap and/or the base may be telescopingly disposed over the side walls of the container. Although a container having a removable cap or top cover is depicted and illustrated in the following description, it will be understood that the term "closure" as used in the teachings of this invention describes removable top and base covers as well as the top and bottom telescoping portions of containers having no side walls.

The security clip 10 is formed of suitable material, preferably a metallic material such as steel. More preferably, the security clip 10 is formed of a metallic material having a certain amount of resiliency, such as spring steel, so as to enable slight movement of the projection portions of the security clip 10, as described in greater detail hereafter.

The security clip 10 is formed by conventional means, such as by blanking or stamping operations, wherein the clip 10 is initially formed from sheet material into a suitably dimensioned strip. The thickness of the strip is chosen depending upon the particular application involved, with the length of the strip similarly chosen such that the security clip 10, when further formed and applied to the container, will be completely covered by the closure.

Thus, the strip of metallic material is bent into a substantially U-shaped member formed of first and second spaced leg portions 12 and 14, respectively, which are joined at one end thereof by a curved portion 16 to form a continuous member. The leg portions 12 and 14 are spaced apart a predetermined distance, depending upon the particular side wall thickness of the container involved, such that when the security clip 10 is disposed over the side wall of the container, the leg portions 12 and 14 will be in substantial registry with the side walls of the container. It should be noted that the distance between the legs 12 and 14 may be varied so as to suit a wide variety of different wall thicknesses. It should further be noted that the depending end portions 18 and 20 of the legs 12 and 14, respectively, are further bent in an outward direction, away from the opposing leg, so as to facilitate installation of the security clip 10 over the side walls of the container. As noted above, the length of the strip and, therefore, the length of respective legs 12 and 14 is chosen to be less than the length of the side wall of the closure such that the security clip 10, when disposed in position over the top edge of the side wall of the container, will be completely covered by the depending side portions of the closure member.

Figure 4:
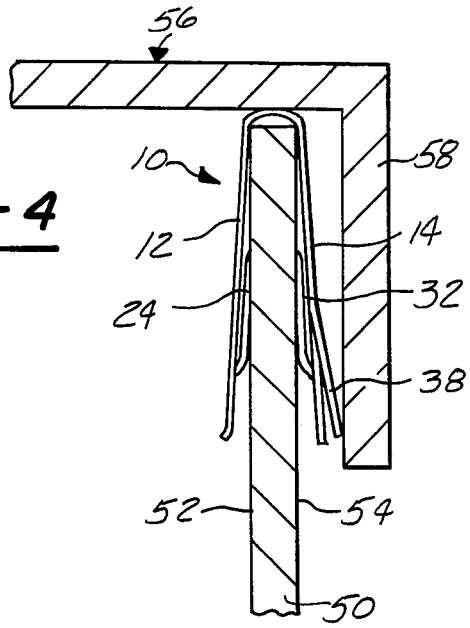
FIG. 4 is a pictorial representation illustrating the disposal of the container security clip and the top cover over the top edge of the side wall of an open-ended container.

According to the teachings of this invention, the legs 12 and 14 of the security clip 10 are each formed with an integral sharpened projection, the purpose of which will be described in greater detail hereafter. Thus, the leg portion 12 of the security clip 10, which, as shown in FIG. 4, is disposed in registry with the inside surface of the side wall 50 of the container, includes at least one, and preferably two integral sharpened projections, such as projections 22 and 24. In the preferred embodiment the integral projections 22 and 24 are spaced apart so as to be disposed adjacent to the side of the leg portion 12 of the security clip 10.

The projections 22 and 24 may be formed in any conventional manner, such as by stamping or punching the projections out of the leg portion 12. Thus, each projection 22 and 24 includes a first end 26 which is integral with the remaining portion of the leg 12 and a vertically upstanding second end 28 which extends upward from the integrally formed first end 26 and is disposed between the legs 12 and 14 of the security clip 10.

As shown more clearly in FIG. 2, the projections, such as projection 24, are formed so as to be substantially extending in an upward or vertical direction from the end 18 of the leg 12 and the integral portion 26 of the projection 24 formed thereon. Further, the upward end portion 28 of the projection 24 is preferably bent or suitably formed so as to be directed towards the opposing leg, such as leg 14. The end portion 28 of the projection 24 further includes suitably sharpened edges 30, the purpose of which will be described in greater detail hereafter.

According to the teachings of this invention, the opposing leg 14 of the security clip 10 likewise includes at least one integral sharpened projection, such as projection 32. According to the preferred embodiment, the projection 32, like the projections 22 and 24 in the leg 12, has a first end portion 34 formed integrally with the leg 14 and extends vertically upward to an upper or second end portion 36 which is disposed between the legs 12 and 14 of the security clip 10. Preferably, the integrally formed end of the projection 32 on the leg 14 is centrally located with respect to the ends and the sides of the leg 14 so as to be located substantially in between the pair of spaced projections 22 and 24 in the corresponding leg 12.

Further, the upper end portion 36 of the projection 32 is formed with a plurality of sharpened edges or serrations, the purpose of which will be described in greater detail hereafter. As shown more clearly in FIG. 2, the projection 32 is formed so as to extend in an upward direction from the integrally formed end 34 to the upper end 36 which is bent slightly so as to face the opposing leg 12. In this manner the projections 22 and 24 in the leg 12 and the projection 32 in the leg 14 allow easy application of the security clip 10, such as by sliding, over the top edge of the side wall of the container since the projections 22, 24 and 32 present a smooth or rounded surface to the side wall when the security clip 10 is applied in a downward direction over the top edge of the side wall of the container. However, due to the angle of the upper ends 28 and 36 of the projections 22, 24 and 32, respectively, the security clip 10 is resisted or hindered in its removal, in an upward direction, from the side wall of the container since the top portions of the projections embed or dig into the side wall of the container, thereby hindering upward movement of the security clip 10, which serves to retain the security clip 10 in place on the side wall of the container. The greater the upward force exerted on the clip, the further the projections 22, 24 and 32 embed in the side wall to resist movement of the clip 10.

The second leg 14 which, as shown in FIG. 4, is that leg which is disposed between the outer surface 54 of the side wall 50 of the container and the corresponding inner surface of the top cover further includes at least one and preferably two second integrally formed, sharpened projections, such as projections 38 and 40. Each of the identically formed projections 38 and 40, which are disposed in spaced relationship on the leg 14 so as to be disposed adjacent to the sides thereof, depend in a downward direction towards the end 20 of the leg 14 from an integrally formed portion 42 to a depending end 44 which is formed in a plurality of sharpened points or edges. Further, the projections 38 and 40 are disposed at a slight angle from the leg 14 so as to extend outward therefrom.

It should also be noted that the installation of the security clip 10 over the top edge of the side wall of the container, as well as the telescoping of the top cover over the side walls of the container and the security clip 10, is facilitated due to the resilient material, such as spring steel, which is preferably used to form the security clip 10. In this manner the ends and the integral projections formed in the security clip 10 give or bend slightly during the application of the security clip 10 or the closure thereover so as to allow easy sliding movement between the security clip 10 and the side walls or closure of the container in a downward direction. However, as described in further detail hereafter, movement of the closure or security clip 10 in an opposing or upward direction is resisted due to the projections on the security clip 10.

As noted above, the ends of the projections 22, 24 and 32, as well as the projections 38 and 40, are formed with sharpened edges or serrations. The length and number of such serrations is chosen to insure that the projections will dig into the side walls of the container or closure. Thus, depending upon material used to construct the container, a greater number of serrations having a greater length may be necessary to insure proper functioning of the security clip 10.

Referring now to FIG. 4, there is shown a pictorial illustration of the disposal or application of the security clip 10 of this invention over the edge of the side wall of the open-ended container, with the corresponding closure telescoped thereover. In the installation of the security clip 10 over the edge of the side wall of the container, the security clip 10 is oriented and applied over the edge of the container such that the leg portion 12 is disposed in registry with the inner surface 52 of the side wall 50 of the container and the second leg 14 is disposed in registry with the outer surface 54 of the side wall 50 of the container. Since the legs 12 and 14, as described previously, have been spaced a predetermined distance apart corresponding to the thickness of the side wall 50 of the container and, further, since the integral projections 22, 24 and 32 formed in the legs 12 and 14, respectively, present a substantially smooth or rounded surface to the side wall during the application of the security clip 10 over the side wall 50 of the container, the security clip 10 may be easily and quickly applied in a single motion over the edge of the side wall of the container.

Preferably, the security clip 10 is located adjacent to the corners of the side walls of the container. However, additional security clips may be disposed along the length of each side wall of the container where necessary in larger sized container applications to provide additional strength to retain the closure in position on the container.

After the goods or commodities are loaded within the container, the closure 56, which includes a depending side portion 58, is telescoped or disposed over the edge of the side wall 50 of the container. Due to the resiliency of the security clip 10, and particularly of the projections 38 and 40, the side portion 58 of the closure 56, which is sized to closely fit the dimensions of the container, slides easily over the security clip 10 into position covering the open end of the container.

Thus, in the application of the security clip 10 over the side wall 50 of the container, the projections 22, 24 and 32 will bend slightly in an outward direction away from the surface of the side wall 50 of the container. Similarly, the second projections 38 and 40 in the leg 14 will bend slightly in a direction toward the side wall 50 of the container to allow the disposal of the closure 56 thereover.

During normal use, such as during handling, shipping and storage of the container, the closure 56 experiences frequent upward forces which tend to force it from the container. Such forces are a result of tipping or bending of the container during handling or shipping or during unauthorized attempts to open or enter the container. However, the novel security clip 10 of this invention resists such upward movement of the closure 56 from the container and provides a visible indication of such unauthorized attempts to open or enter the container.

Figure 5:
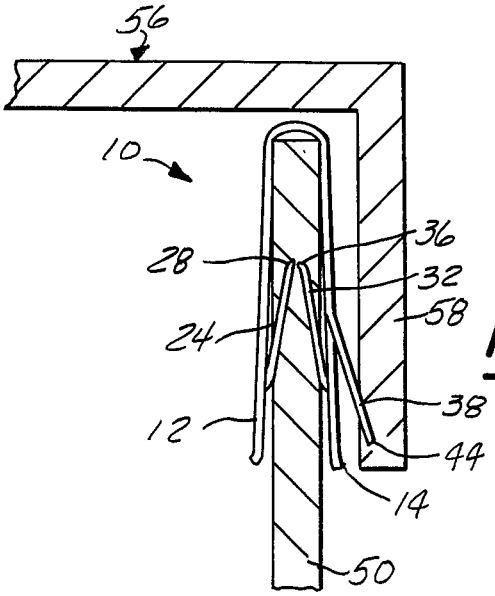
FIG. 5 is a pictorial representation showing the position of the container security clip during the application of an upward force on the top cover, such as during the removal thereof.

As shown more clearly in FIG. 5, which is a pictorial representation of the position of the components of the security clip 10 during a subsequent attempt to remove the closure 56 from the container, it can be seen that the integral sharpened projections 22, 24 and 32, as well as the second projections 38 and 40, in the leg portions 12 and 14, embed or otherwise enter the respective side wall 50 and depending side 58 of the container and closure. This embedding has two effects. For one, the embedding of the projections in the side wall 50 of the container and the closure 56 tends to resist the removal of the closure 56 from the container, as well as to resist the removal or movement of the security clip 10 from the side wall 50 of the container. In this manner the security clip 10 functions to retain the closure 56 over the open end of the container. If additional force is applied, the projections embed further in the side wall 50 and closure 56 to resist movement thereof. However, if sufficient force is continually applied to the closure 56 in an attempt to effect its removal, the integral projections 38 and 40 extending outwardly from the leg 14 will continue to further embed within the side portion 58 of the closure 56 thereby tearing or ripping the closure 56. Such tearing or ripping of the closure 56 provides a visible indication of an unauthorized entry or tampering with the container.

Thus, there has been disclosed herein a novel container security clip adapted to be disposed over the side wall of an open-ended container. The security clip comprises a U-shaped member including first and second spaced legs. The first and second spaced legs have integral sharpened projections extending vertically upward away from the ends of each leg between the legs. The security clip 10 further includes a second integral sharpened projection disposed in one leg thereof which serves to engage and resist the removal of the closure from the container after the closure is telescoped over the open end of the container.

The second, outwardly extending projection on the security clip of this invention provides a visible indication of any attempt to remove the closure from the container since the act of removing the closure from the container causes the sharpened edges at the end of the second projection to embed in the closure 56 and tear or rip the closure. Thus, an indication of any unauthorized entry or tampering with the goods in the container is provided without the costly, time-consuming and difficult to install prior art container sealing devices.

Furthermore, the security clip 10 of this invention is inexpensive to manufacture and is quickly and easily installed over the side wall of the container in a single motion without any additional modification of the basic design of the container to facilitate the adaptation of the sealing devices thereto, as is common in the prior art. Also, the security clip may be applied in a continuous motion without the need for additional steps commonly required to form or embed the fasteners to the side walls of the container and to form the end of the fasteners around the edges of the closure after the same has been telescoped over the container. Finally, the security clip of this invention also uniquely functions to retain the closure on the container at the same time as providing a sealing function. This eliminates, in certain instances, the need for additional securing means, such as straps or bands, which further reduces the overall cost of the container.

What is claimed is:

1. A security clip adapted to be slid over the edge of the side wall of an open-ended container comprising:

a U-shaped member having first and second spaced legs;

each of said first and second spaced legs including at least one integral projection disposed between said first and second legs and extending vertically upward from the depending end of said first and second legs; and one of said first and second legs including at least one second integral projection depending downward towards the end of said one leg and extending outward from said one leg.

2. The security clip of claim 1 wherein the first leg includes two, spaced integral projections.

3. The security clip of claim 1 wherein the second leg includes one integral projection extending towards the opposing leg and two second spaced integral projections extending downward towards the depending end of said second leg.

4. The security clip of claim 1 wherein said security clip is formed of a resilient, metallic material.

5. The security clip of claim 1 wherein the ends of the first and second projections are formed with at least one sharpened edge.

6. The security clip of claim 1 wherein said security clip is adapted to be slid over the edge of the side wall of a container with the first leg disposed in registry with the inside surface of said side wall and the second leg disposed in registry with the outside surface of said side wall such that the second projection on said second leg embeds within and tears the telescoping side of the closure when the closure is urged upward away from the side wall of the container to resist such upward movement and to provide an indication of such attempted removal of the closure from the side wall of the container.

7. The security clip of claim 1 wherein a plurality of security clips are provided on the side wall of the container.

8. A security clip adapted to be slid over the edge of the side wall of a container comprising:

a substantially U-shaped member having first and second spaced legs;

said first leg including two spaced, integral sharpened projections extending vertically upward away from the depending end of the first leg and in between said first and second legs of said U-shaped member;

said second leg including one integral sharpened projection extending vertically upward from the end of said second leg and in between said first and second legs of said U-shaped member and two spaced, second integral sharpened projections extending downward towards said end of said second leg and extending outward from said second leg.

9. A container including side walls, an open end and a closure for covering said open end, comprising:

a substantially U-shaped member having first and second spaced legs, said U-shaped member being adapted to be disposed over the edge of said side wall of said container in registry with opposing surfaces of said side wall of said container;

each of said first and second legs of said U-shaped member having an integral first projection extending away from the end of said first and second leg and in between said first and second legs such that said U-shaped member can be slid over the edge of the side wall of said container, with said integral projections in said first and second legs resisting subsequent upward movements of said U-shaped member from said side wall of said container by embedding the end therein in said side wall of said container; and the one of said first and second legs of said U-shaped member disposed between the outer surface of said side wall of said container and said closure further including at least one integral second projection extending downward towards the end of said one leg and outward towards said closure so as to allow said closure to be disposed over the open end of said container and said U-shaped member and, further, to resist removal of said closure from said side wall of said container by embedding in said closure as said closure is urged in an upward direction from said side wall of said container.

10. The container of claim 9 wherein the first leg of said U-shaped member includes two spaced integral, upward extending projections and the second leg of said U-shaped member includes one integral upward extending projection and two spaced integral, second projections.

* * * * *